US010400765B2

(12) United States Patent
Blankemeier et al.

(10) Patent No.: US 10,400,765 B2
(45) Date of Patent: Sep. 3, 2019

(54) ROTOR ASSEMBLIES HAVING RADIAL DEFORMATION CONTROL MEMBERS

(71) Applicant: PEOPLEFLO MANUFACTURING, INC., Franklin Park, IL (US)

(72) Inventors: William R. Blankemeier, Oak Park, IL (US); Jorge G. Murphy, Bolingbrook, IL (US); Clark J. Shafer, Bolingbrook, IL (US); Michael P. Thompson, Chicago, IL (US); Daniel T. Turner, Villa Park, IL (US)

(73) Assignee: PeopleFlo Manufacturing, Inc., Franklin Park, IL (US)

( * ) Notice: Subject to any disclaimer, the term of this patent is extended or adjusted under 35 U.S.C. 154(b) by 181 days.

(21) Appl. No.: 15/432,709

(22) Filed: Feb. 14, 2017

(65) Prior Publication Data

US 2018/0230994 A1 Aug. 16, 2018

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/10*** | (2006.01) |
| ***F04C 15/00*** | (2006.01) |

(52) U.S. Cl.

CPC ..... *F04C 2/10* (2013.01); *F04C 15/0069* (2013.01); *F04C 15/0073* (2013.01); *F04C 2240/20* (2013.01); *F04C 2270/19* (2013.01); *F05C 2251/02* (2013.01); *F05C 2251/046* (2013.01)

(58) Field of Classification Search

CPC .... F04C 2/10; F04C 15/0069; F04C 15/0073; F04C 2240/20; F04C 2270/19; F05C 2251/046; F05C 2251/02

USPC ..... 418/152, 169–171, 178–179

See application file for complete search history.

(56) References Cited

U.S. PATENT DOCUMENTS

| | | | | |
|---|---|---|---|---|
| 2,140,966 | A * | 12/1938 | Nichols | F04C 2/10 418/171 |
| 3,331,258 | A | 7/1967 | Eckerle et al. | |
| 3,998,112 | A | 12/1976 | Pierrat | |
| 4,117,746 | A | 10/1978 | Pierrat | |
| 4,135,863 | A | 1/1979 | Davis et al. | |
| 4,271,726 | A | 6/1981 | Ryffel | |
| 4,316,707 | A | 2/1982 | Hansen et al. | |

(Continued)

FOREIGN PATENT DOCUMENTS

| | | | |
|---|---|---|---|
| GB | 2240590 | A | 8/1991 |
| IT | 1227116 | B | 3/1991 |
| JP | 2005307902 | A * | 11/2005 |

OTHER PUBLICATIONS

International Search Report and Written Opinion for PCT/US2018/017003 dated Apr. 13, 2018.

*Primary Examiner* — Theresa Trieu
(74) *Attorney, Agent, or Firm* — Cook Alex Ltd.

(57) ABSTRACT

The disclosure provides a gear pump rotor assembly that includes a rotor body, a rotor head having a plurality of gear teeth and being connected to the rotor body, at least one connector extending between the rotor body and the rotor head, at least one radial deformation control member that extends into at least one gear tooth of the rotor head and reduces the radial deformation of the rotor head relative to the rotor body when a change in temperature causes radial deformation of the rotor body and rotor head.

19 Claims, 7 Drawing Sheets

(56) References Cited

U.S. PATENT DOCUMENTS

| | | | | |
|---|---|---|---|---|
| 4,578,608 | A | 3/1986 | Mech et al. | |
| 4,602,727 | A | 7/1986 | Jackson | |
| 4,722,661 | A | 2/1988 | Mizuno | |
| 4,976,594 | A | 12/1990 | Bernstrom | |
| 5,211,551 | A | 5/1993 | Uppal et al. | |
| 5,313,125 | A | 5/1994 | Bosman et al. | |
| 5,365,137 | A | 11/1994 | Richardson et al. | |
| 5,531,537 | A * | 7/1996 | Pink | F04C 2230/90 418/179 |
| 5,735,668 | A | 4/1998 | Klein | |
| 5,833,445 | A | 11/1998 | Van Spijk | |
| 5,876,192 | A * | 3/1999 | Follmer | F04C 2230/90 418/179 |
| 5,895,203 | A | 4/1999 | Klein | |
| 5,939,807 | A | 8/1999 | Patyk et al. | |
| 6,315,080 | B1 | 11/2001 | Doran | |
| 6,578,674 | B2 | 6/2003 | Doran | |
| 6,659,728 | B2 * | 12/2003 | Bush | F04C 2/101 418/169 |
| 6,681,898 | B1 | 1/2004 | Doran | |
| 7,137,793 | B2 | 11/2006 | Shafer et al. | |
| 7,781,926 | B2 | 8/2010 | Schmidt et al. | |
| 2004/0130228 | A1 | 7/2004 | Chang | |
| 2006/0008368 | A1 | 1/2006 | Czechowski et al. | |
| 2006/0192453 | A1 | 8/2006 | Gieras et al. | |
| 2006/0193741 | A1 | 8/2006 | Wanschura et al. | |
| 2008/0197740 | A1 | 8/2008 | Hughes | |
| 2010/0180720 | A1 | 7/2010 | Kempf et al. | |
| 2012/0177511 | A1 | 7/2012 | Sexton et al. | |

* cited by examiner

ROTOR ASSEMBLIES HAVING RADIAL DEFORMATION CONTROL MEMBERS

BACKGROUND OF THE INVENTION

The present invention generally relates to rotary gear pumps, and more specifically to rotary gear pump rotor assemblies for use in pumps seeking high efficiency and/or capability to operate within wide temperature ranges.

It is well-known to one skilled in the prior art that rotary gear pump performance is considerably affected by clearances between rotating gear teeth and the adjacent stationary surfaces within a pump, such as the pump casing. To maximize efficiency, it is desirable to minimize these clearances to the greatest extent possible without inducing contact between the rotating gear teeth and the stationary surfaces. Contact may lead to galling, wear, and a variety of additional disadvantageous issues. However, it is further known that such clearances are engineered to maintain operability and a desired efficiency within a well-defined temperature range, and that clearances will change, due to thermal expansion, as temperature increases or decreases. In general, the deformation of the pump components in response to temperature changes may be affected by the material composition and shape of the components, and by other complex factors.

In prior art pumps with a wide operational process temperature range, a geared rotor is typically constructed of a material with a coefficient of thermal expansion similar to that of the casing. This is intended to minimize changes to designed clearances and, consequently, to maintain operability and favorable efficiency throughout the designed temperature range. However, this may restrict the selection of appropriate materials to a subset which may not necessarily include materials that are most appropriate for a particular application, as may be defined by preferred or required mechanical properties, competitive cost, or other factors. Such situations may require a sacrifice in material properties, tightness of clearances affecting pump efficiency, or broadness of process temperature range.

The issue may be characterized by an instance in which it is desirable to employ a thermoplastic material for rotor gear teeth, perhaps to take advantage of the material's resistance to galling and favorable low wear properties. However, the thermoplastic material may have a significantly greater coefficient of thermal expansion than a non-thermoplastic pump casing material. In absence of the present invention, a pump designer must generally chose to forego said advantages of thermoplastic rotor gear teeth, increase design clearances and, consequently, reduce efficiency for a substantial portion of the operational temperature range, or reduce the operational temperature range such that an acceptable efficiency may be achieved throughout.

The present invention addresses shortcomings in prior art gear pumps by providing a way to avoid the aforementioned sacrifice in material properties, pump efficiency, or process temperature range.

SUMMARY OF THE INVENTION

The disadvantages of the prior art are overcome by example gear pump rotor assemblies of the present disclosure. In a first aspect, the disclosure provides a gear pump rotor assembly that includes a rotor body, a rotor head having a plurality of gear teeth and being connected to the rotor body, at least one connector extending between the rotor body and the rotor head, and at least one radial deformation control member that extends into at least one gear tooth of the rotor head, wherein the at least one radial deformation control member reduces the radial deformation of the rotor head relative to the rotor body when a change in temperature causes radial deformation of the rotor body and rotor head.

In all embodiments, the rotor body is substantially constructed of a first material with a first modulus of elasticity and a first coefficient of thermal expansion, and the rotor head is substantially constructed of a second material with a second modulus of elasticity and a second coefficient of thermal expansion, wherein the first modulus of elasticity is greater than the second modulus of elasticity and the second coefficient of thermal expansion is greater than the first coefficient of thermal expansion. In some embodiments the first modulus of elasticity is at least ten times greater than the second modulus of elasticity. At least one connector extends between the rotor head and the rotor body and generally serves to connect the rotor head and rotor body in a direction parallel to a rotor assembly axis of rotation. The at least one radial deformation control member is at least partially in rigid contact with the rotor head and the rotor body at a well-defined radial position. In some embodiments, the at least one connector also may serve as the at least one radial deformation control member. Thus, it should be appreciated that qualification as a connector or a radial deformation control member is not necessarily mutually exclusive.

If independent of a rotor body, in response to a change in temperature, an unrestrained rotor head would tend to deform radially in proportion to the change in temperature and the coefficient of thermal expansion, and a well-defined radial position on the rotor head will move radially by a first distance. An unrestrained rotor body would tend to deform radially, but having a coefficient of thermal expansion that is less than that of the rotor head, a well-defined radial position on the rotor body will move radially by a second distance, which is less than the first distance.

An assembled rotor head and rotor body of the present disclosure have a common radial position of the at least one radial deformation control member that is at least partially in rigid contact with both the rotor head and rotor body. In response to a change in temperature, the resulting radial position of the at least one radial control member would move by a third distance that is between the unrestrained first distance for the rotor head and the unrestrained second distance for the rotor body. The modulus of elasticity of the rotor body being greater than that of the rotor head ensures that the third distance for the assembled rotor head and rotor body is substantially nearer the second distance for the unrestrained rotor body than the first distance for the unrestrained rotor head. The result being that the radial deformation of the rotor head is influenced to substantially follow the radial deformation of the rotor body, and generally to be reduced by such influence.

Thus, the present invention will allow materials with dissimilar coefficients of thermal expansion to be used for a rotor head and rotor body while avoiding the previously stated disadvantageous sacrifices of prior art rotors in material properties, pump efficiency, or acceptable process temperature range.

It should be appreciated that the coefficient of thermal expansion is used throughout the present disclosure as a general quantifiable figure used in expressing the magnitude of the deformation of a material in response to a change in temperature. It is understood that the coefficient itself may be subject to change with varying physical conditions. It is further understood that this property is not necessarily isotropic, and references to the coefficient of thermal expansion within the present disclosure should be interpreted to be as relating to the directions relevant for control of radial deformation, as will be described.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred example embodiments, reference is made to the accompanying drawing figures wherein like parts have like reference numerals, and wherein.

Figure 1:
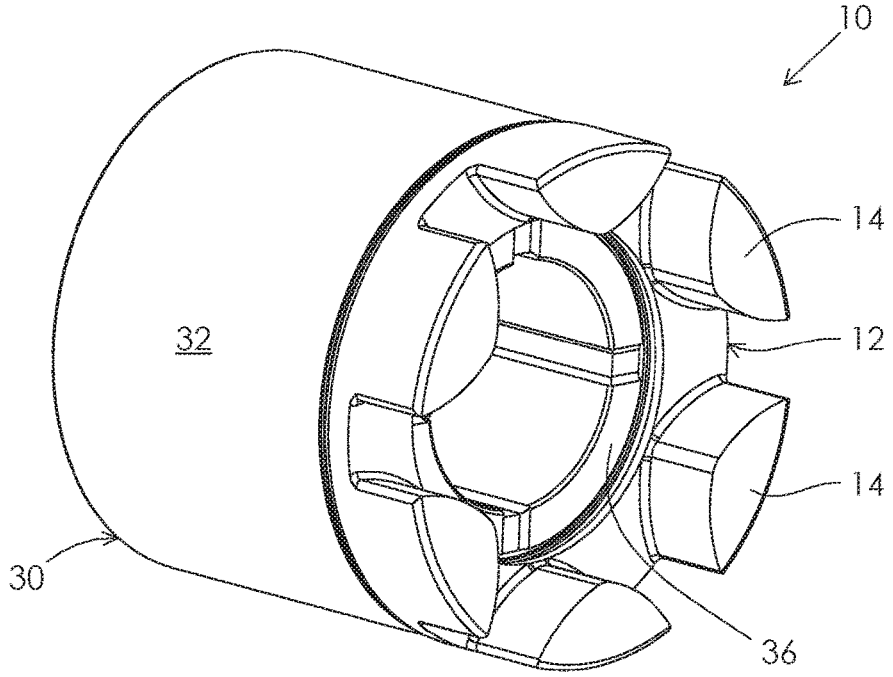
FIG. 1 shows a perspective front view of a first example rotor assembly.
Figure 2:
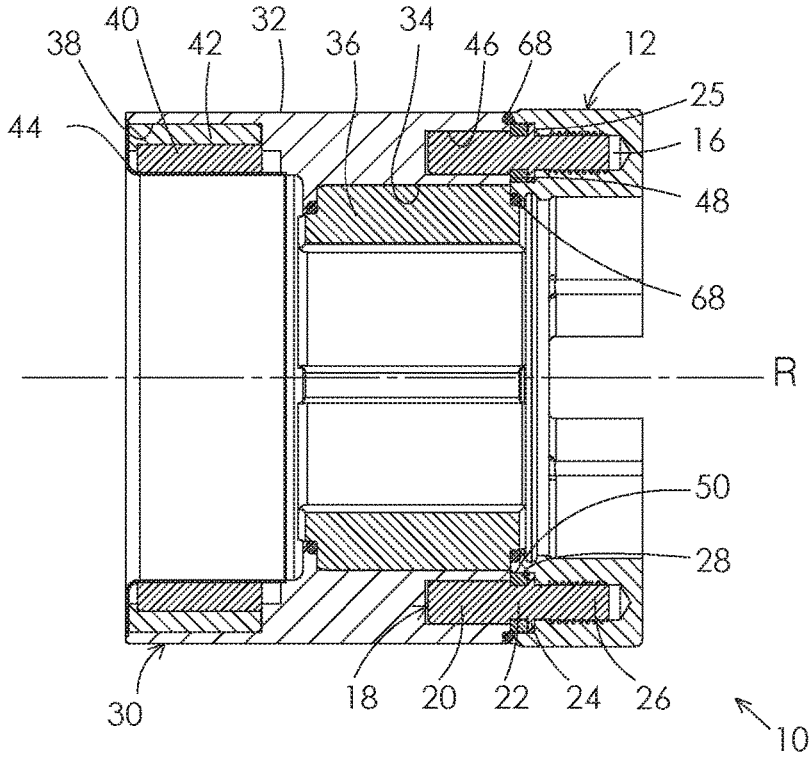
FIG. 2 shows a sectioned side view of the first example rotor assembly of FIG. 1.

It should be understood that the drawings are not to scale. While some mechanical details of the example pumps, including details of fastening means and other plan and section views of the particular components, may not have been shown, such details are considered to be within the comprehension of those skilled in the art in light of the present disclosure. It also should be understood that the present disclosure and claims are not limited to the preferred embodiments illustrated.

DETAILED DESCRIPTION OF PREFERRED EMBODIMENTS

Referring generally to FIGS. 1-12, it will be appreciated that pump rotor assemblies of the present disclosure generally may be embodied within numerous configurations. Indeed, the teachings within this disclosure may pertain to pump rotors for use in a variety of rotary gear pumps.

For instance, FIGS. 1-4 illustrate the present invention in a first preferred example embodiment as a configuration of a magnetically driven internal gear pump rotor assembly 10 including a rotor head 12 and a rotor body 30. The rotor assembly 10 has an axis of rotation R.

In this first example, the construction of the rotor body 30 may include a first material with a first modulus of elasticity and a first coefficient of thermal expansion, and the construction of the rotor head 12 may include a second material with a second modulus of elasticity and a second coefficient of thermal expansion. It will be appreciated that the first and second materials are different and preferably the first modulus of elasticity is greater than the second modulus of elasticity and the second coefficient of thermal expansion is greater than the first coefficient of thermal expansion, such as if the first material is a metal and the second material is a thermoplastic or other material that is less likely to encounter galling in a pumping cavity of a pump casing. Indeed, in some embodiments the first modulus of elasticity may be at least ten times greater than the second modulus of elasticity.

The rotor head 12 is generally cylindrical and has a plurality of gear teeth 14 protruding inwardly and axially forward. It should be understood that the term "forward" is used arbitrarily herein with respect to location in a pump, and to refer to the position of the rotor head 12 relative to the rotor body 30. The rotor head 12 further comprises a plurality of threaded cavities 16 positioned circumferentially about the rotor assembly axis of rotation R, which are open rearward at a rearward facing surface 28 of the rotor head 12. Illustrated in FIGS. 2 and 3, the cavities 16 extend at least partially into the plurality of gear teeth 14. The rotor head 12 further comprises a plurality of locking pins 18. Each locking pin 18 is in the form of a threaded stud and has a head 20, a neck 22, a flange 24, and a threaded portion 26. The threaded portion 26 of each locking pin 18 is in threaded engagement with a threaded cavity 16 to a maximum depth defined by engagement of a forward facing surface of the flange 24 and the rearward facing surface 28 of the rotor head 12. The neck 22 is defined by a length of the locking pin 18 between the head 20 and the flange 24, and which has a smaller diameter than both the head 20 and the flange 24. In this example, each locking pin 18 serves simultaneously as at least one connector and at least one radial deformation control member, as will be described.

The rotor body 30 has a substantially cylindrical outer surface 32 and a first central aperture 34 into which a bushing 36 or other friction reducing means is connected to support the rotor body assembly 10 as it rests slidably and rotatably about an inner journal, which is not shown. The rotor body 30 has a second central aperture 38, having a larger diameter than that of the first, and containing a plurality of magnet segments 40. The magnet segments 40 are positioned circumferentially and so as to have alternating polarity. The plurality of magnet segments 40 may be attached directly to the rotor body 30 or may be attached to an intermediate annular ring 42, which is connected to the rotor body 30, such as is shown in the first example depicted in FIGS. 2 and 3. The magnet segments 40 generally are sealed to avoid contamination by a thin annular sleeve 44, which is fixedly and sealingly connected to the rotor body 30.

The rotor body 30 further comprises a plurality of cavities 46 open to a forward facing surface 48 of the rotor body 30 and positioned circumferentially about the axis of rotation R so as to generally correspond with the positions of the locking pins 18 of the rotor head 12. The plurality of cavities 46 are aligned with the plurality of heads 20 of locking pins 18, so as to receive the heads 20 and restrain radial displacement of the heads 20. The rotor body cavities 46 are partially covered by an annular locking ring 50, which is connected to the rotor body 30 at the forward facing surface 48. In this example, the annular locking ring 50 is connected to the rotor body 30 by a plurality of fasteners 52, such as screws or by other well-known fastening means.

Figure 3:
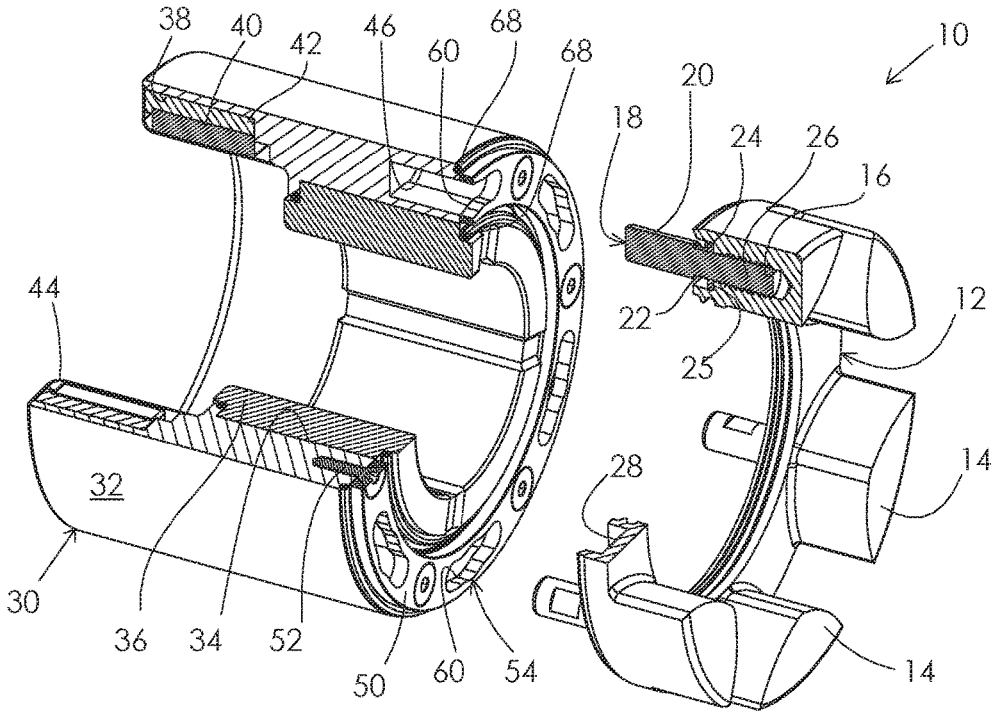
FIG. 3 shows a perspective quarter-sectioned, partially exploded front view of the first example rotor assembly of FIG. 1.
Figure 4:
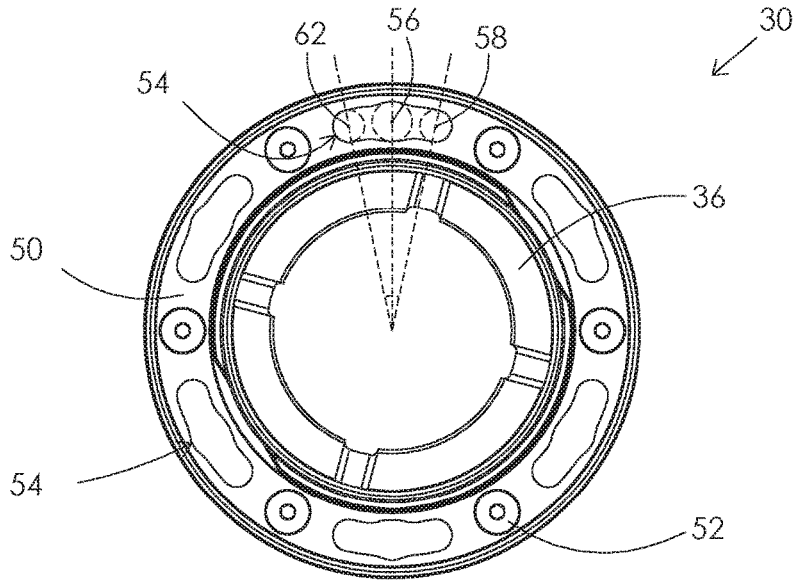
FIG. 4 shows an end view of a rotor body of the first example rotor assembly of FIG. 1.

The locking ring 50 includes a plurality of apertures 54 generally corresponding to the quantity and position of the cavities 46. However, the shape of the apertures 54 in the locking ring 50 is such that, at a first angular position of the rotor head 12 relative to the rotor body 30, herein referred to as the insertion position 56, the heads 20 of the plurality of locking pins 18 of the rotor head 12 may simultaneously be passed through the locking ring 50 and be received within the rotor body cavities 46. Further, as best seen in FIGS. 3 and 4, the shape of the apertures 54 in the locking ring 50 is such that, at a second angular position of the rotor head 12 relative to the rotor body 30, herein referred to as the locking position 58, each aperture 54 has a narrowed portion that is narrower than a locking pin head 20 and wider than a locking pin neck 22, thereby forming a partial shoulder 60 for each cavity 46, from which the locking pin head 20 is restrained from being displaced axially forward. Further, at the locking position 58, a head 20 or neck 22 of a locking pin 18 is additionally restrained, by the shape or circumferential length of the cavity 46 or aperture 54, from rotating relative to the rotor body 30 in the direction of the rotation from the insertion position 56 to the locking position 58. Thus, the locking pins 18 act to at least partially allow the transmission of torque between the rotor body 30 and the rotor head 12. The area of the shoulder 60 also may be of a different thickness to help retain the locking position, once it is achieved. It should be appreciated that the geometry created by the locking ring 50 may be integral to the forward surface 48 of the rotor body 30 so as to obtain the same results without the need for a plurality of fasteners 52.

The first preferred embodiment of the gear pump rotor assembly 10 is assembled when the rotor head 12 is axially displaced toward the rotor body 30 at the insertion position 56 until each locking pin head 20 is received by a rotor body cavity 46, and then the rotor head 12 is rotated relative to the rotor body 30 to the locking position 58. It should be appreciated that the rotor head 12 and the rotor body 30 shall remain operatively connected provided that an intended direction of rotation of the rotor assembly 10 is opposite the direction of rotation of the rotor head 12 from the insertion position 56 to the locking position 58. Further, it should be appreciated that O-rings 68 are utilized to seal the internal connecting features from a process fluid to which the rotor assembly 10 is exposed.

The first embodiment of the present invention, as illustrated in FIGS. 1-4, includes a second locking position 62 having a narrowed portion, which is in the opposite direction of rotation from the first locking position 58, so as to be on the opposite side of the insertion position 56. Thus, the gear pump rotor assembly 10 can be assembled to be used in a clockwise or counter-clockwise rotational direction.

In this example, the locking pins 18 serve as connectors, as well as radial deformation control members, which are received by and rigidly in contact with the cavities 16 in the rotor head 12 and the cavities 46 or apertures 54 of the rotor body 30. As such, the locking pins 18 influence the radial deformation of the rotor head 12 by forcing the radial position of the cavities 16 in the rotor head 12 to follow the radial position of the cavities 46 in the rotor body 30, thus reducing the radial deformation of the rotor head 12 relative to the rotor body 30 when a change in temperature causes radial deformation of the rotor body 30 and rotor head 12.

Figure 5:
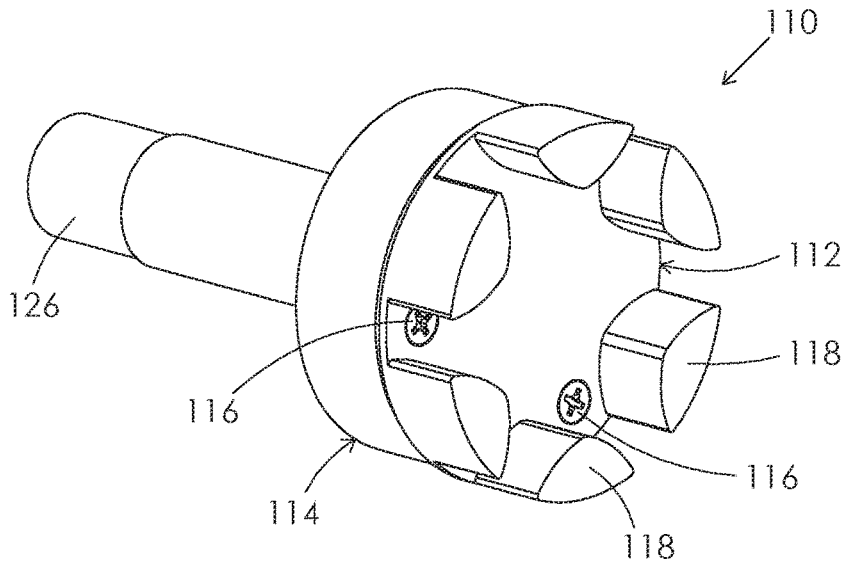
FIG. 5 shows a perspective front view of a second example rotor assembly.
Figure 6:
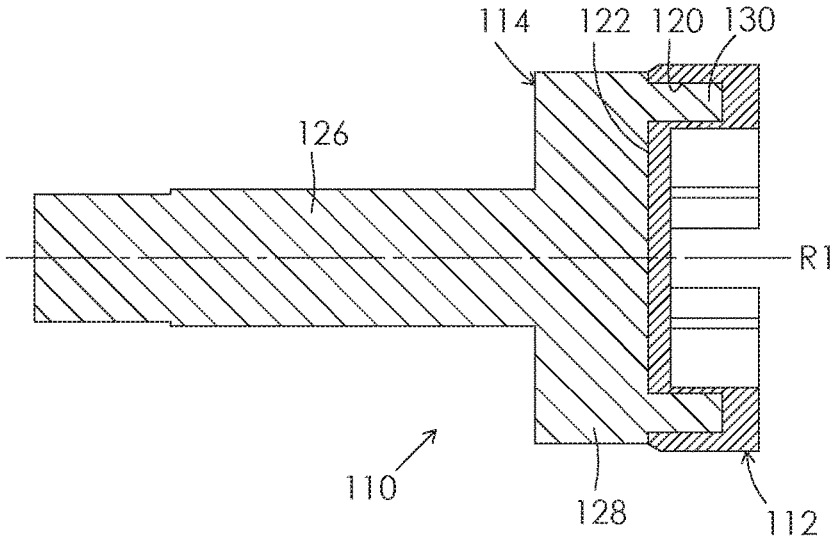
FIG. 6 shows a sectioned side view of the second example rotor assembly of FIG. 5.
Figure 7:
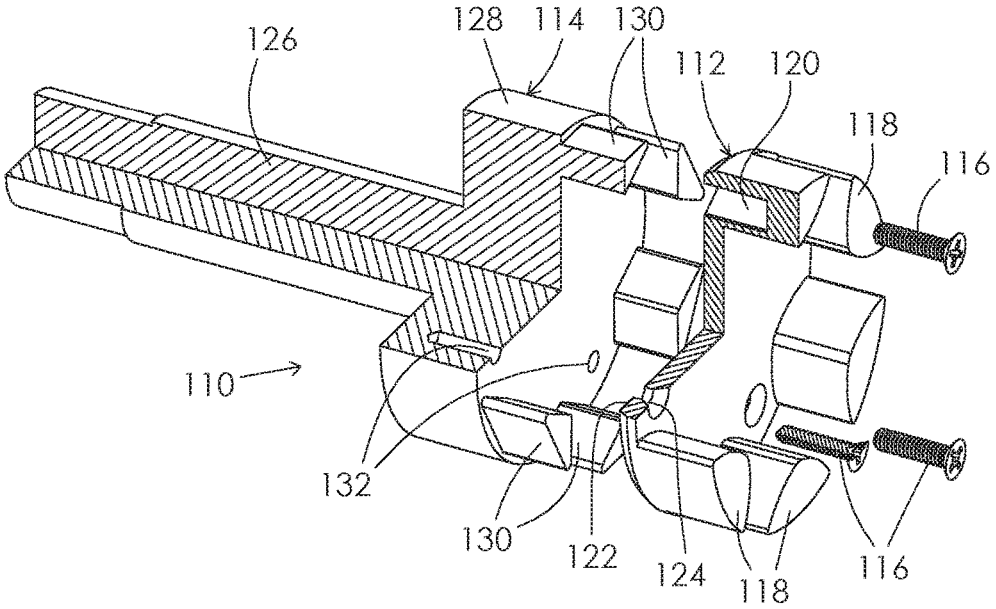
FIG. 7 shows a perspective quarter-sectioned exploded front view of the second example rotor assembly of FIG. 5.

Turning to FIGS. 5-7, a second example embodiment is illustrated in a configuration of a gear pump rotor assembly 110 including a rotor head 112, a rotor body 114, and a plurality of fasteners 116 used to removably attach the rotor head 112 to the rotor body 114. It will be appreciated that the above statements regarding the materials of the rotor body and rotor head of the first example embodiment are equally applicable to the second example embodiment.

The generally cylindrical rotor head 112 includes a plurality of gear teeth 118 protruding inwardly and axially forward and a plurality of cavities 120 positioned circumferentially about a rotor assembly axis of rotation R1 and open rearward at a rearward facing surface 122 of the rotor head 112. The rotor head 112 further includes a plurality of through-holes 124 which are positioned circumferentially about the axis of rotation R1, and each of which includes a forward facing counter-bore and receives one of the plurality of fasteners 116, which are shown for example in the form of a threaded screw.

The rotor body 114 includes an integral shaft member 126 to which input torque may be applied, and a substantially cylindrical forward portion 128 from which a plurality of integral protruding members 130 extend axially forward and are positioned so as to correspond to the positions of the plurality of cavities 120 in the rotor head 112. The protruding members 130 are sized and shaped to be received within the cavities 120 in the rotor head 112. The protruding members 130 serve as radial deformation control members and influence the radial deformation of the rotor head 112, as the cavities 120 of in the rotor head 112 are forced to follow the radial positions of the protruding members 130 as the temperature of the rotor assembly 110 changes. In this way, the radial deformation control member reduces the radial deformation of the rotor head relative to the rotor body when a change in temperature causes radial deformation of the rotor body and the rotor head. The rotor body 114 is further comprised of a plurality of threaded cavities 132 positioned to correspond to the through-holes 124 in the rotor head 112.

The plurality of fasteners 116, shown as screws in the second embodiment, are connectors which extend between the through-holes 124 of the rotor head 112 and the threaded cavities 132 of the rotor body 114, axially connecting the rotor head 112 and the rotor body 114.

It should be appreciated that, in such a configuration as represented by the second example embodiment, the plurality of fasteners 116 or the protruding members 130 may be configured to provide the anti-rotational support required for the transmission of torque between the rotor head 112 and the rotor body 114.

Figure 8:
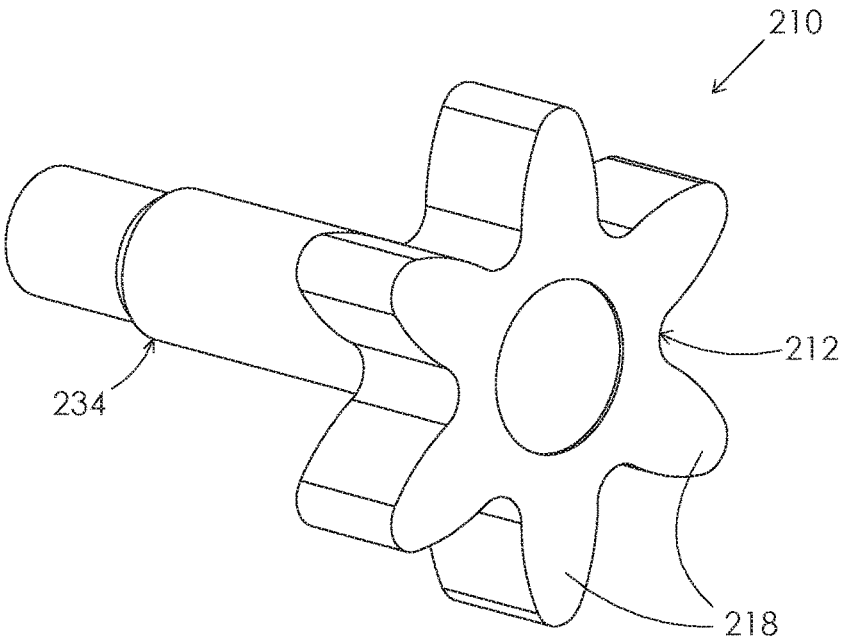
FIG. 8 shows a perspective front view of a third example rotor assembly.
Figure 9:
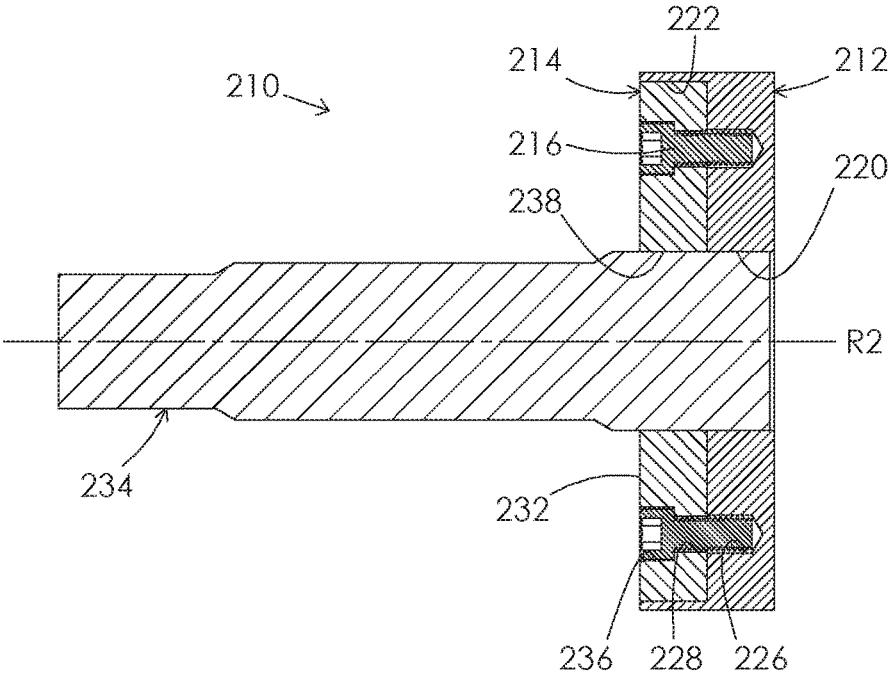
FIG. 9 shows a sectioned side view of a third example rotor assembly of FIG. 8.
Figure 10:
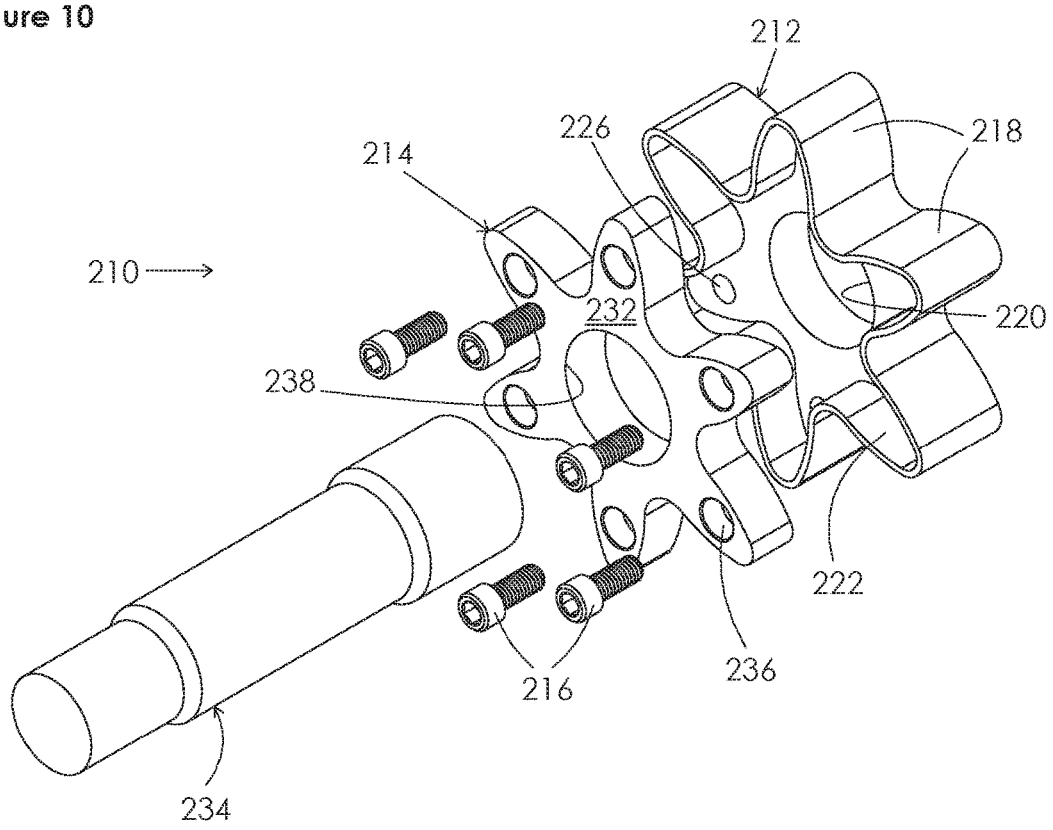
FIG. 10 shows a perspective exploded rear view of the third example rotor assembly of FIG. 8.

FIGS. 8, 9, and 10 illustrate a third example embodiment in a configuration of a gear pump rotor assembly 210 that includes a rotor head 212, a rotor body 214, and a plurality of fasteners 216. It will be appreciated that the above statements regarding the materials of the rotor body and rotor head of the first example embodiment are equally applicable to the third example embodiment.

The rotor head 212 includes a plurality of outwardly extended gear teeth 218 and a central aperture 220. The rotor head 212 further includes a rear cavity 222 having the profile of the gear teeth 218 with an inward offset and plurality of threaded cavities 226 positioned circumferentially about a rotor assembly axis of rotation R2 and extending into the gear teeth 218. The plurality of threaded cavities 226 are open to the rear cavity 222. It should be appreciated that the shape of the rear cavity 222 is not required to have the profile of the gear teeth 218, providing that the shape of the rear cavity 222 is such that the threaded cavities 226 can be positioned so as to extend substantially into the gear teeth 218.

The rotor body 214 is generally of the shape of the rear cavity 222 of the rotor head 212 and can be approximately contained within the rear cavity 222 radially and axially, but it should be appreciated that the present invention is only limited by the claimed subject matter. The rotor body 214 further comprises a plurality of through holes 228 which correspond to the plurality of threaded cavities 226 in the rotor head 212 and includes counter bores 236 open to the rear facing surface 232. The rotor body 214 includes a central aperture 238 which is used to fixedly attach a shaft 234 via interference fit or other well-known anti-rotational and axially positioning features.

In the third preferred embodiment, the plurality of fasteners 216 are in the form of screws and are connectors extending through the through-holes 228 of the rotor body 214 and received in the threaded cavities 226 which are positioned in the rotor head 212 circumferentially about the axis of rotation R2; connecting the rotor head 212 and rotor body 214 axially. Thus, in the absence of an additional means for the fixation of the common radial position, the plurality of fasteners 216, being of an appropriate cross-sectional area and stiffness, serve as connectors and as radial deformation control members that influence the radial deformation of the rotor head 212 by forcing the radial position of the threaded cavities 226 in the rotor head 212 to follow the radial position of the through holes 228 in the rotor body 214. In this way, the radial deformation control member reduces the radial deformation of the rotor head relative to the rotor body when a change in temperature causes radial deformation of the rotor body and the rotor head. In the third example embodiment, the plurality of fasteners 216 or the contact between the rotor head 212 and rotor body 214 in a plane perpendicular to the axis of rotation R2 can be configured to provide the anti-rotational support required for the communication of torque between the rotor head 212 and the rotor body 214.

Figure 11:
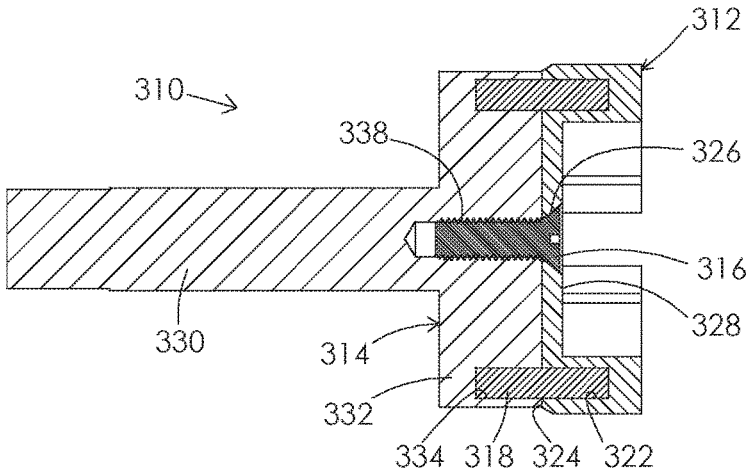
FIG. 11 shows a sectioned side view of a fourth example rotor assembly.
Figure 12:
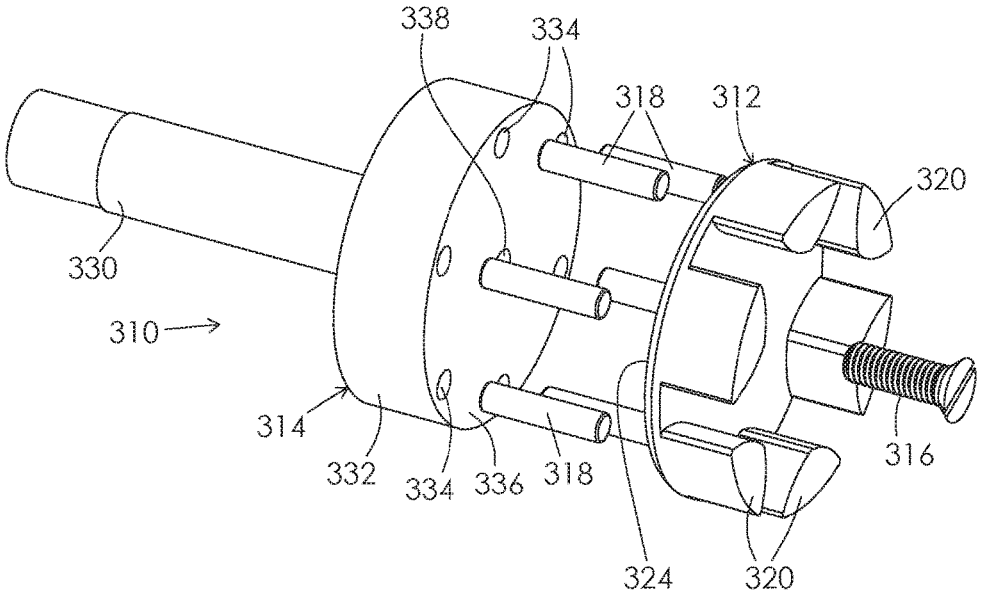
FIG. 12 shows a perspective exploded front view of the fourth example rotor assembly of FIG. 11.

FIGS. 11 and 12 illustrate a fourth example embodiment representing a gear pump rotor assembly 310 that includes a rotor head 312, a rotor body 314, a fastener 316, and a plurality of dowels 318. It will be appreciated that the above statements regarding the materials of the rotor body and rotor head of the first example embodiment are equally applicable to the fourth example embodiment.

The generally cylindrical rotor head 312 includes a plurality of gear teeth 320 protruding inwardly and axially forward, a plurality of cavities 322 in a rearward facing surface 324 of the rotor head 312, and a central aperture 326 having a counter-bore open to a forward facing surface 328 of the rotor head 312 and being suitable for the fastener 316.

The rotor body 314 includes an integral shaft member 330, to which input torque may be applied, and a substantially cylindrical forward portion 332 having a plurality of cavities 334 in a forward facing surface 336 of the forward portion 332 which correspond to the plurality of cavities 334 in the rotor head 312 and a central threaded cavity 338, which also is open to the forward facing surface 336. The fastener 316 extends through the central aperture 326 of the rotor head 312 and into the threaded cavity 338 of the rotor body 314 so as to axially attach the rotor head 312 and the rotor body 314.

The plurality of studs or dowels 318 serve as radial deformation control members and are received in and extend from the plurality of circumferentially positioned cavities 322 of the rotor head 312 to the corresponding plurality of circumferentially positioned cavities 334 of the rotor body 314. The radial deformation control members 318 influence the radial position of the plurality of cavities 322 of the rotor head 312 to follow the radial position of the plurality of cavities 334 in the rotor body 314. In this way, the radial deformation control member reduces the radial deformation of the rotor head relative to the rotor body when a change in temperature causes radial deformation of the rotor body and the rotor head. The plurality of dowels 318 also provide the anti-rotational support to allow the communication of torque between the rotor head 312 and the rotor body 314.

It will be appreciated that a rotor assembly constructed in accordance with the present disclosure may be provided in various configurations. Any variety of suitable materials of construction, configurations, shapes and sizes for the components and methods of connecting the components may be utilized to meet the particular needs and requirements of an end user. Indeed, rotor assemblies in accordance with the present disclosure may include connecting members and radial deformation control members that are separate components or are embodied in the same components. The components of the rotor assemblies may be constructed of specific materials and/or have particular surface finishes wherein the surfaces permit use of the pumps in various applications, including hygienic applications where microbial growth must be prevented. It will be apparent to those skilled in the art that various modifications can be made in the design and construction of such rotor assemblies without departing from the scope or spirit of the claimed subject matter, and that the claims are not limited to the preferred embodiments illustrated herein. It also will be appreciated that some aspects of the example embodiments are discussed in a simplified manner, as the invention is capable of being implemented in various rotor assemblies for use in different devices, including gear pumps, whether such devices include dynamic seals between rotating parts or are magnetically driven.

The invention claimed is:

1. A gear pump rotor assembly comprising:

a rotor body;

a rotor head having a plurality of individual, spaced apart gear teeth protruding forward axially, with each gear tooth having a cavity that is open rearward at a rearward facing surface of the rotor head;

at least one connector extending between the rotor body and the rotor head which axially connects the rotor head to the rotor body;

each respective gear tooth of the plurality of gear teeth receives into the rearward facing cavity of the respective gear tooth one of a plurality of rigid radial deformation control members that extend forward axially from the rotor body and are radially fixed relative to the rotor body, and wherein the respective one rigid radial deformation control member is at least partially in rigid contact with the respective gear tooth and forces the radial position of the rearward facing cavity in the respective gear tooth to radially follow the respective rigid radial deformation control member extending from the rotor body so as to reduce the radial deformation of the respective gear tooth of the rotor head relative to the rotor body when a change in temperature causes radial deformation of the rotor body and rotor head.

2. The gear pump rotor assembly of claim 1 wherein at least one of the rigid radial deformation control members also is one of the at least one connectors extending between the rotor body and the rotor head.

3. The gear pump rotor assembly of claim 1 wherein the at least one connector is received within at least one cavity in a forward end of the rotor body.

4. The gear pump rotor assembly of claim 1 wherein the at least one connector is received within at least one cavity that is open rearward at the rearward facing surface of the rotor head.

5. The gear pump rotor assembly of claim 1 wherein the at least one connector further comprises a plurality of connectors positioned circumferentially about an axis of rotation of the rotor body.

6. The gear pump rotor assembly of claim 5 wherein the rotor head includes a plurality of rearwardly open cavities that receive the plurality of connectors positioned circumferentially about the axis of rotation of the rotor body.

7. The gear pump rotor assembly of claim 1 wherein the rotor body is constructed of a first material and the rotor head is constructed of a different second material.

8. The gear pump rotor assembly of claim 7 wherein the first material of the rotor body has a first coefficient of thermal expansion and the second material of the rotor head has a second coefficient of thermal expansion, and the first coefficient of thermal expansion is lower than the second coefficient of thermal expansion.

9. The gear pump rotor assembly of claim 7 wherein the first material of the rotor body has a first modulus of elasticity and the second material of the rotor head has a second modulus of elasticity, and the first modulus of elasticity is greater than the second modulus of elasticity.

10. The gear pump rotor assembly of claim 9 wherein the first modulus of elasticity is greater than the second modulus of elasticity by at least a factor of ten.

11. The gear pump rotor assembly of claim 7 wherein the second material comprises thermoplastic.

12. The gear pump rotor assembly of claim 7 wherein the second material comprises metal.

13. The gear pump rotor assembly of claim 1 wherein the at least one connector is a fastener.

14. The gear pump rotor assembly of claim 13 wherein the fastener is a screw or a threaded stud.

15. The gear pump rotor assembly of claim 14 wherein at least the rotor body or rotor head includes a cavity having threads.

16. The gear pump rotor assembly of claim 1 wherein the cavity that is open rearward at the rearward facing surface of the rotor head extends partially into the gear tooth.

17. The gear pump rotor assembly of claim 1 wherein the plurality of rigid radial deformation control members are received in respective cavities in a forward end of the rotor body.

18. A gear pump rotor assembly comprising:

a rotor body;

a rotor head having a plurality of individual, spaced apart gear teeth protruding forward axially, with each gear tooth having a cavity that is open rearward at a rearward facing surface of the rotor head;

at least one connector extending between the rotor body and the rotor head which axially connects the rotor head to the rotor body;

each respective gear tooth of the plurality of gear teeth receives into the rearward facing cavity of the respective gear tooth one of a plurality of rigid radial deformation control members that extend forward axially from the rotor body and are radially fixed relative to the rotor body, and wherein the respective one rigid radial deformation control member is at least partially in rigid contact with the respective gear tooth and forces the radial position of the rearward facing cavity in the respective gear tooth to radially follow the respective rigid radial deformation control member extending from the rotor body so as to reduce the radial deformation of the respective gear tooth of the rotor head relative to the rotor body when a change in temperature causes radial deformation of the rotor body and rotor head;

wherein the rotor body is constructed of a first material and the rotor head is constructed of a different second material; and wherein the first material of the rotor body has a first coefficient of thermal expansion and the second material of the rotor head has a second coefficient of thermal expansion, and the first coefficient of thermal expansion is lower than the second coefficient of thermal expansion.

19. A gear pump rotor assembly comprising:

a rotor body;

a rotor head having a plurality of individual, spaced apart gear teeth protruding forward axially, with each gear tooth having a cavity that is open rearward at a rearward facing surface of the rotor head;

at least one connector extending between the rotor body and the rotor head which axially connects the rotor head to the rotor body;

each respective gear tooth of the plurality of gear teeth receives into the rearward facing cavity of the respective gear tooth one of a plurality of rigid radial deformation control members that extend forward axially from the rotor body and are radially fixed relative to the rotor body, and wherein the respective one rigid radial deformation control member is at least partially in rigid contact with the respective gear tooth and forces the radial position of the rearward facing cavity in the respective gear tooth to radially follow the respective rigid radial deformation control member extending from the rotor body so as to reduce the radial deformation of the respective gear tooth of the rotor head relative to the rotor body when a change in temperature causes radial deformation of the rotor body and rotor head;

wherein the rotor body is constructed of a first material and the rotor head is constructed of a different second material; and wherein the first material of the rotor body has a first modulus of elasticity and the second material of the rotor head has a second modulus of elasticity, and the first modulus of elasticity is greater than the second modulus of elasticity.

* * * * *